US005850889A

United States Patent [19]

Rexroad et al.

[11] Patent Number: 5,850,889

[45] Date of Patent: Dec. 22, 1998

[54] SINGLE POST SAFETY ANCHOR

[76] Inventors: John Rexroad, 12 Jackson Road, Killingworth, Conn. 06419; C. Warren Duncan, 2725 Freemont Lane, Costa Mesa, Calif. 92626

[21] Appl. No.: 932,062

[22] Filed: Sep. 15, 1997

Related U.S. Application Data

[63] Continuation of Ser. No. 437,414, May 12, 1995, abandoned.

[51] Int. Cl.[6] ..... A47L 3/04; E04G 1/36

[52] U.S. Cl. ..... 182/3; 182/45

[58] Field of Search ..... 182/3, 45

[56] References Cited

U.S. PATENT DOCUMENTS

| | | | |
|---|---|---|---|
| 863,173 | 8/1907 | Haskell . | |
| 2,336,144 | 12/1943 | Wickstrom . | |
| 2,439,063 | 4/1948 | Shur . | |
| 2,575,254 | 11/1951 | Blaugrund . | |
| 2,628,796 | 2/1953 | Krizman . | |
| 3,022,855 | 2/1962 | Lewis . | |
| 3,137,487 | 6/1964 | Lesser . | |
| 3,193,050 | 7/1965 | Galante | 182/3 |
| 3,269,679 | 8/1966 | Grappo . | |
| 3,408,780 | 11/1968 | Brister . | |
| 3,618,883 | 11/1971 | Cohn . | |
| 4,226,058 | 10/1980 | Riley . | |
| 4,249,713 | 2/1981 | Glynn et al. . | |
| 4,606,430 | 8/1986 | Roby et al. . | |
| 4,607,724 | 8/1986 | Hillberg . | |
| 4,928,789 | 5/1990 | Claeys . | |
| 4,928,790 | 5/1990 | Franks . | |
| 4,942,943 | 7/1990 | Flaherty . | |
| 5,004,071 | 4/1991 | Mallard et al. . | |
| 5,011,106 | 4/1991 | Cody . | |
| 5,029,670 | 7/1991 | Whitmer | 182/3 |
| 5,036,949 | 8/1991 | Crocker et al. . | |
| 5,054,576 | 10/1991 | Glynn . | |
| 5,137,112 | 8/1992 | Nichols . | |
| 5,143,170 | 9/1992 | Hunt et al. . | |
| 5,143,171 | 9/1992 | Glynn et al. . | |
| 5,156,233 | 10/1992 | Olsen et al. . | |
| 5,221,076 | 6/1993 | Züst . | |

FOREIGN PATENT DOCUMENTS

| | | | |
|---|---|---|---|
| 0643655 | 8/1962 | Italy | 182/3 |

*Primary Examiner*—Charles A Marmor
*Assistant Examiner*—Matthew A. Kaness
*Attorney, Agent, or Firm*—Perman & Green, LLP

[57] ABSTRACT

A single post anchor for lifelines is provided with a generally elongate member having at one end a means configured to engage about a structural member and having a clamping assembly which acts on another surface of the structure to secure the anchor in place. A swivel is provided as part of the anchor to which a retractable lifeline device or the like is attached.

17 Claims, 9 Drawing Sheets

SINGLE POST SAFETY ANCHOR

This application is a continuation of copending application Ser. No. 08/437,414 filed on May 12, 1995 abandoned.

BACKGROUND OF THE INVENTION

The present invention relates to a lifeline safety anchor and, more particularly relates to an improvement in such an anchor whereby a lifeline anchor securable to an existent structure is attached readily and safely by a user without the heretofore known problems associated with lifeline anchorages which are both bulky, heavy and require more than a single anchoring point.

Lifeline systems are well-known in the art of roofing, construction or maintenance of structures, such as, buildings, homes, frames, etc., whereby a worker or maintenance person working above grade and usually standing on a decking which is inclined secures himself against fall by "hooking in" to a lifeline anchor. In this way, the worker or maintenance person is secured against accidentally falling from the decking to the ground. Moreover, federal standards, such as those set by the Occupational Safety and Health Association (OSHA), are being implemented to protect workers against such incidents, and these standards will call for the mandatory use of lifelines to prevent accidental falls. Thus, the need for providing anchorages which can be made inexpensively, yet be capable of safely and effectively anchoring a lifeline to existent structure is apparent.

In U.S. Pat, No. 5,054,576, an anchor assembly for a roof lifeline system is disclosed. The anchor assembly is defined by a frame which receives a lifeline housing in which is disposed a coiled line oriented by the frame so that the line outlet from the housing is oriented upwardly from the roof peak. Shoulders extend from the frame and are oriented for surface-to-surface engagement on opposing sides of the pitched roof. Anchors are inserted through openings formed in the shoulders and are secured to the roof for anchoring the bracket assembly and, hence, the lifeline to the roof. Such structure is problematic in that the boxlike frame is large and cumbersome and, furthermore, requires the use of baseplates provided with openings through which anchors secure the frame to the existent structure at least two points. In addition to the previously discussed problems associated with the size of the frame and the material requirements for such framework, the need to secure the frame to a decking at more than one securement point is problematic in that it adds time and requires more labor in the placement and securement of the anchor to the decking.

Also, attempts have been made to provide safety devices for roof work wherein very elaborate means are provided to effect a stable anchoring structure. Such a device is disclosed in U.S. Pat. No. 5,143,170. Here, it can be appreciated that the structure which is used as the anchorage must be constructed so as to provide a stable anchor to which a safety line can be attached. Such structure includes the use of metal pairs of sleeper bars with at least one transverse bar connecting the metal pairs of sleeper bars to one another. Conversely, drawbacks are likewise associated with even the most simplistic systems which employ anchors for securing lifelines to an existent structure. An example of a system which can be so characterized as simplistic, and which nevertheless has inherent drawbacks is found in U.S. Pat. No. 5,137,112. As disclosed in this patent, an anchor member is provided in the form of a U-shaped nail which is driven into wooden structural member to effect securement of a lifeline. The problems attendant to using such an anchoring means is that it does not leave the structural members intact without some form of disruption. Additional problems associated with this type of anchor include the lack of repeatability of effecting a consistent connection between the safety device or the structure. That is, the device must be hammered into the wooden member and somehow removed, which ultimately could lead to splitting of the wood and/or other material damage to the structural member. Also, in the event that the support beams are made from an impenetrable material, such as, steel beams, the use of such an anchor is impossible.

Accordingly, it is an object of the present invention to provide a roof anchor which is capable of being readily and safely secured to existent structure at a single anchoring point irrespective of the material from which the structure is made.

A further object of the invention is to provide a roof anchor of a simple construction which is so designed as to lend itself to being readily inserted through an opening in a decking and thereafter secured to a frame member of the structure without causing the frame member to be damaged.

Still further, an object of the invention is to provide an anchor which is capable of being secured to existent building structure absent decking being constructed over the frame structure.

Still, a further object of the invention is to provide an anchor which is capable of mounting a lifeline to it, such that the mounted lifeline is capable of paying out in any direction from the anchor.

Other objects and advantages of the invention will become apparent through an understanding of the below disclosure and the appended claims.

SUMMARY OF THE INVENTION

The invention resides in a single post anchor for securing a line or a safety device to a structure comprising an elongate member having a first end and an opposite second end extending along a central axis generally coincident with the first and second ends. Engagement means is disposed generally at the second end of the elongate member for engaging a surface of a structure and cooperates with a clamping means associated with said elongate member for clamping the anchor member to a structure. The clamping means is disposed on the elongate member for movement axially between the first and the second ends of the elongate member for acting against another surface of a structure so as to clamp the anchor to the structure. The anchor also includes means for connecting a line or safety device to said anchor.

The invention further resides in a method of securing an anchor to an existent structure whereby the anchor member is provided with a means for clamping the anchor to a structural member. A swivel connection means is provided along one portion of the anchor for allowing a life line to be secured thereto for rotational movement so that the lifeline pays out in the direction where the worker is moving.

DETAILED DESCRIPTION OF THE PREFERRED EMBODIMENT

Figure 1:
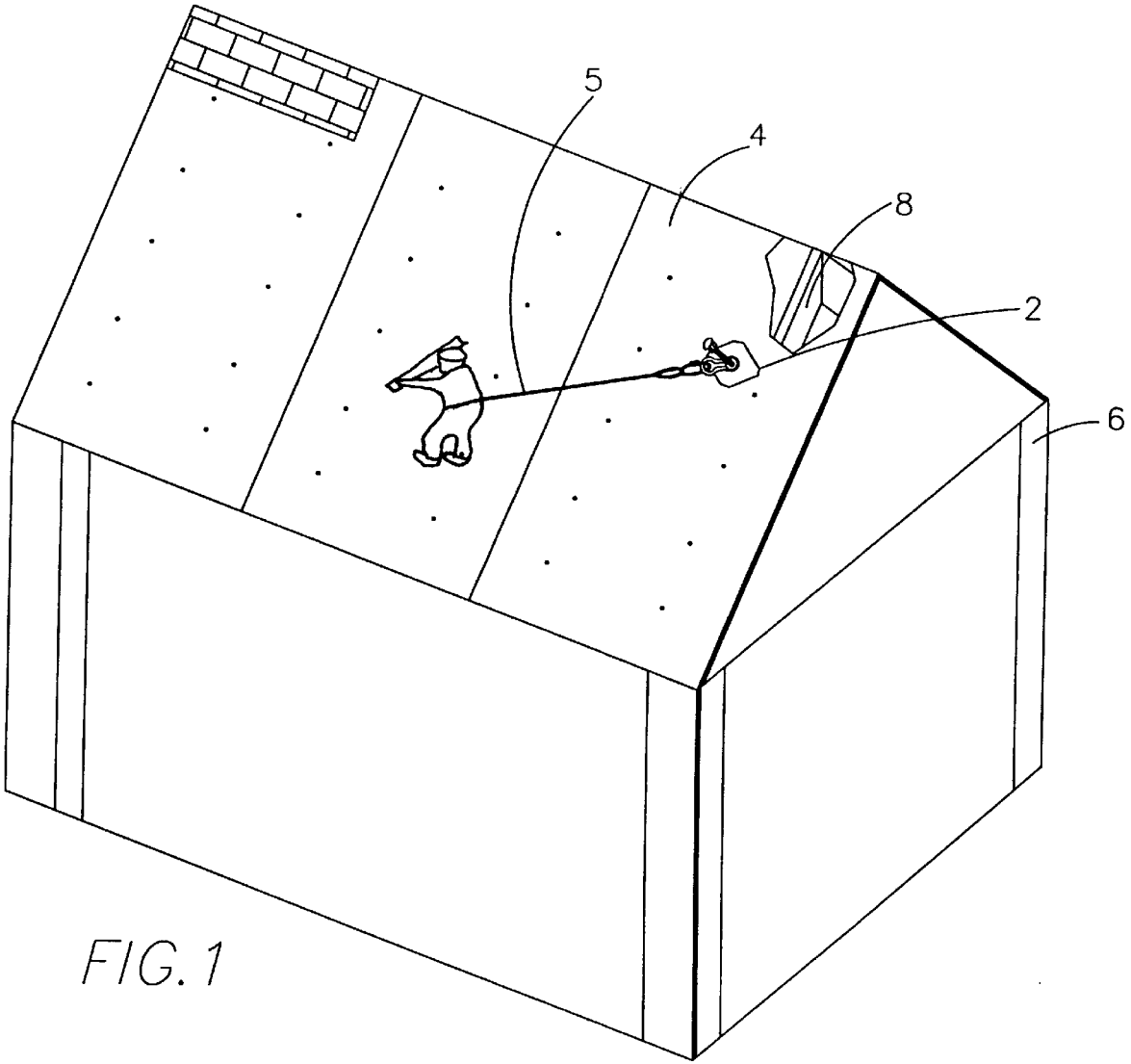
FIG. 1 is a perspective view illustrating a single anchor mounted to a frame.
Figure 2:
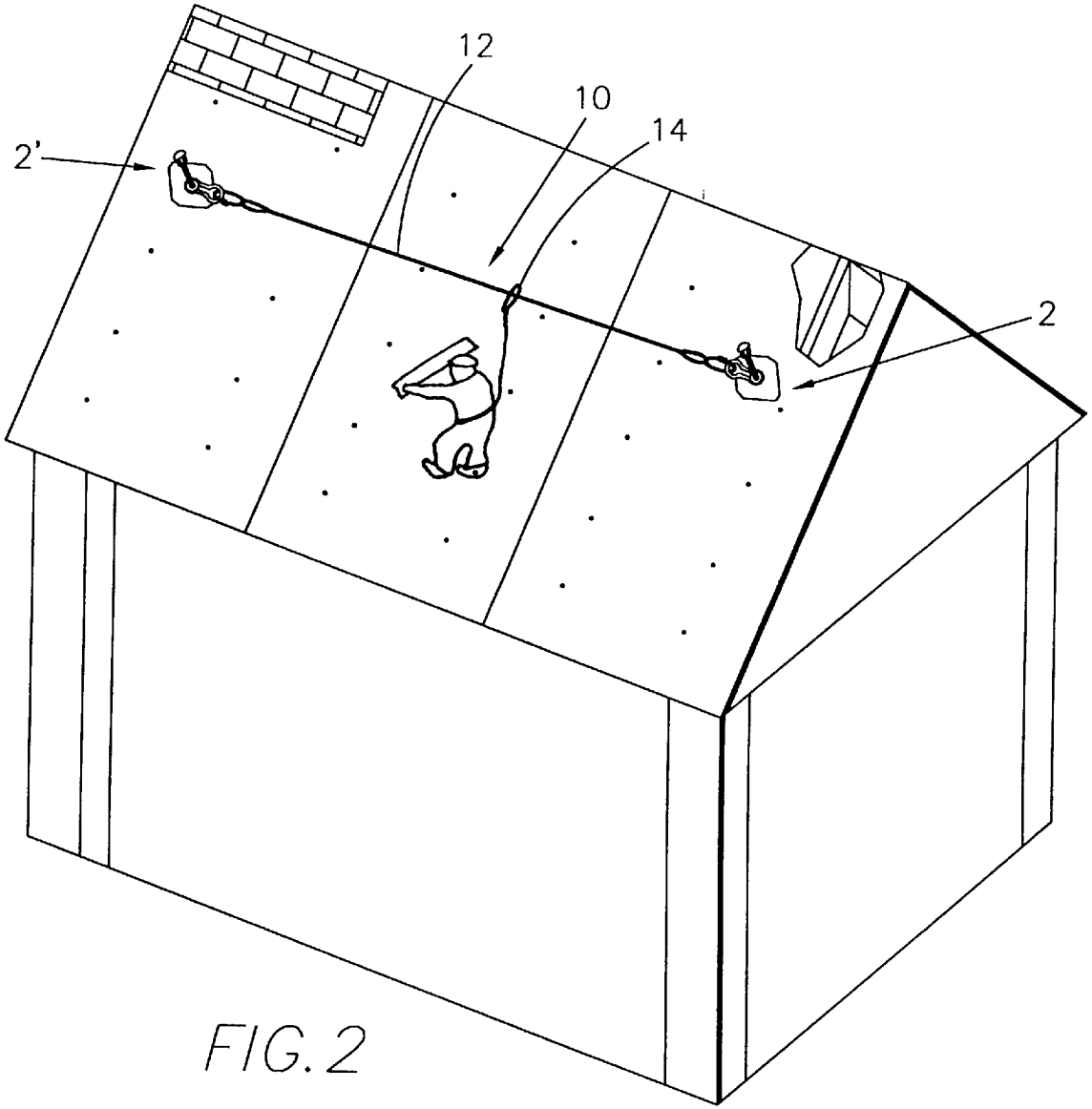
FIG. 2 is a perspective view showing a dual anchorage mount system mounted to an existent frame structure.

FIG. 1 illustrates a roof anchor as disposed on the decking of an existent structure 6. The structure 6 can be any of a number of structures, but in the illustrated example is a framing for a peaked roof structure having decking 4 disposed thereon. The decking 4 is usually plywood material, pressboard or the like which is nailed onto framing members shown in breakaway view as 8,8. These members usually have dimensions of two by eight, or two by ten inches and are framed at 90 degree angles to the decking 4. Additionally, the members 8,8 can take the form of trusses which are constructed of two by four lumber pieces or of other approved material. The anchor 2 as illustrated in FIG. 1 can be used as a single mount device dedicated to, for example, securing a single user by the safety means 5 to a single anchorage the existent structure 6, or, alternatively, as illustrated in FIG. 2, can be used as part of a system 10 whereby two such anchors 2,2' are mounted spatially from each other and interconnected by a walking cord means 12 to which a safety line 5' is attached through the intermediary of a connecting hook 14. The walking cord means 12 may also include a standard tensioner which causes the line to be pulled tautly. It should be understood therefore that as used herein, the term safety means covers a wide variety of devices, including lanyards and retractable lifelines, which are connected to an anchor and to a worker for arresting falls from a structure.

Figure 3:
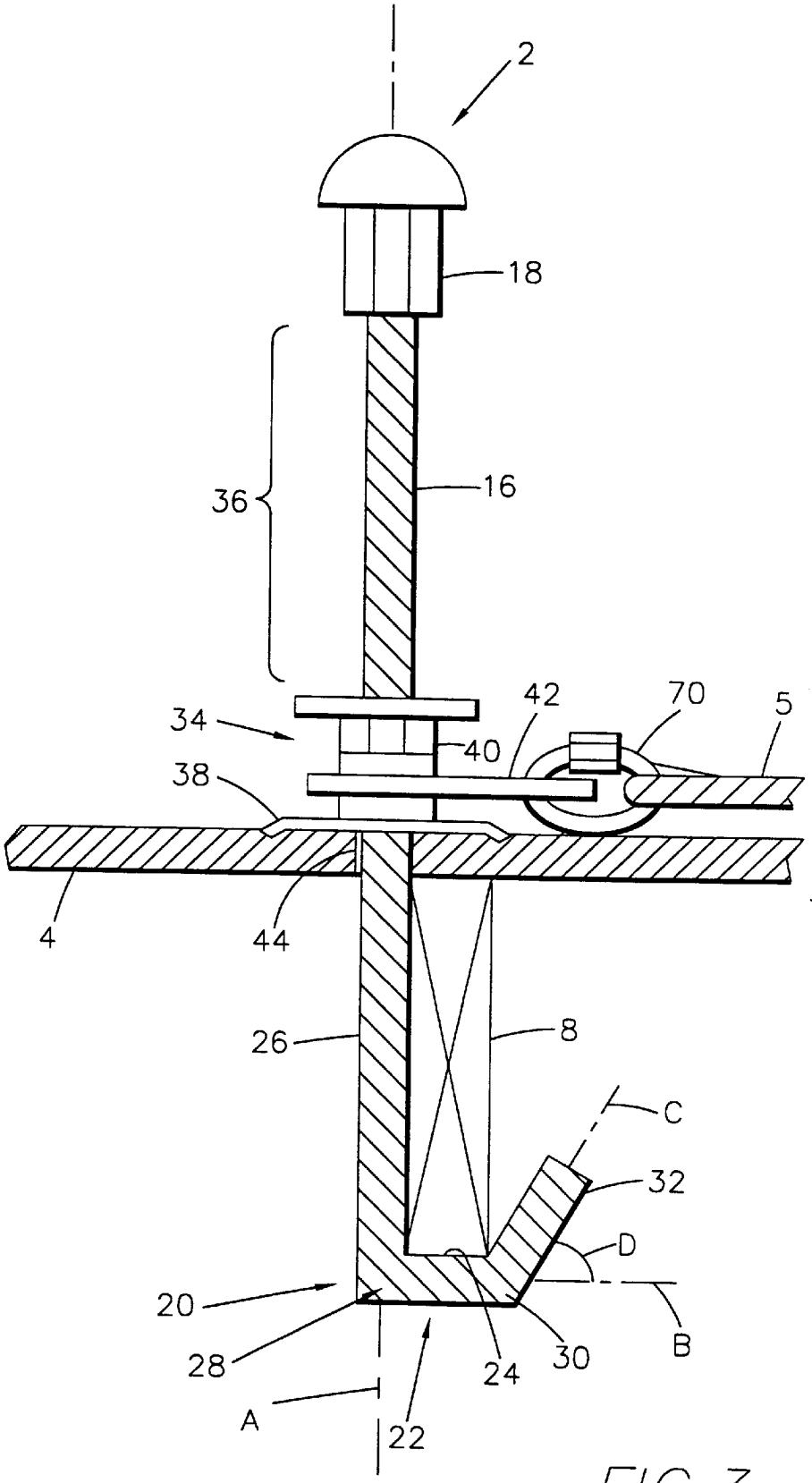
FIG. 3 is a partially fragmentary elevation view showing an anchor secured to a frame member.

Referring now to FIG. 3, and particularly to the construction of the anchor 2, it should be seen that the anchor 2 is comprised of a generally elongate member 16 having a first end 18 associated with the upper free end portion of the member and a second end 20 associated with the lower end portion of the anchor 2, and a means 22 integrally connected with the lower end portion 20 for engaging with one surface 24 of the structural member 8. The anchor member 2 is defined by a straight shank portion 26 which extends between the first end 18 and the second end 20 substantially along a major axis A, and includes as part of the means 22, a hook member 28 defined by a first part 30 which extends along a first minor axis B, and a second part 32 disposed along a second minor axis C which is oriented at angle D, relative to the minor axis B. The anchor member has a substantially uniform diameter through it, thereby making the transitions between the shank portion 26 and the first and second parts 30 and 32 smooth and contiguous, but such smooth and contiguous transitions in the hook member, while helpful, are not critical to the practice of the invention. Notwithstanding, by way of example, the illustrated dimension OD is equal to about five-eights of an inch.

The anchor assembly 2 further includes a clamping means 34 associated with the straight shank portion 26 of the anchor for causing the first part 30 of the hook member 28 to be drawn against the face 24 of the structural member 8 in the manner illustrated in FIGS. 3 and 9. To these ends, the shank portion is provided with means 34 which includes thread means 36 disposed substantially along the elongate shank portion 26 of the member 2, a clamping plate 38 having an opening slidable along the shank portion 26 for engaging with and clamping to the decking 4 of the structure as illustrated by the example of FIG. 3, and a locking nut 40 threadily engaged with the thread means 36 for axial movement along the major axis A of the shank position 26 to effect clamping of the plate 38 with the structure. A means 42 is also provided as part of the clamping means 34 and is associated with the locking nut 40 for rotational or swivel movement about the major axis A in 360 degree directions. A plastic cap 3 may further be provided and fitted onto the upper end of the shank portion to protect workers from the exposed top end of the anchor.

Figure 4A:
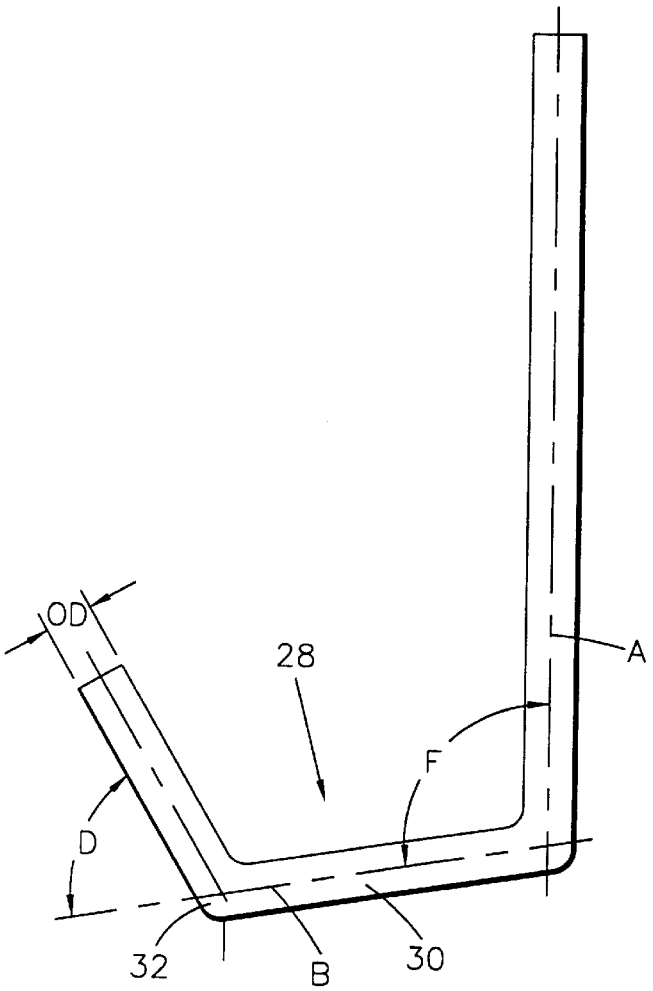
FIG. 4*a* is a fragmentary view of the lower end portion of the elongate member constituting the anchor assembly.
Figure 4B:
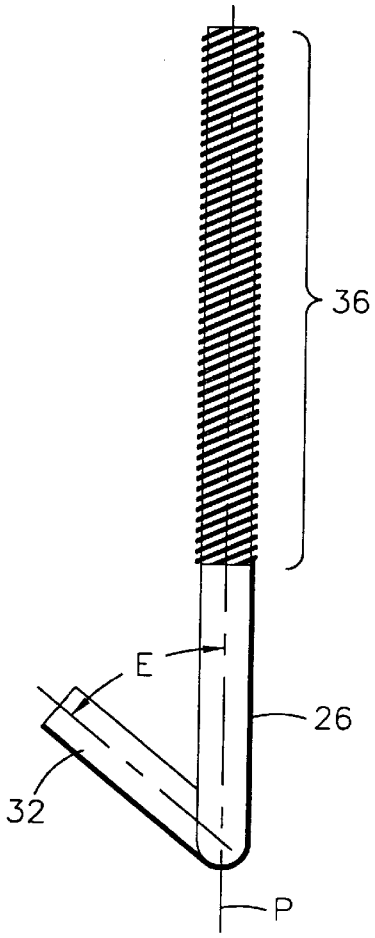
FIG. 4*b* is a view of the lower end of the anchor showed in FIG. 4*a* turned ninety degrees.
Figure 4C:
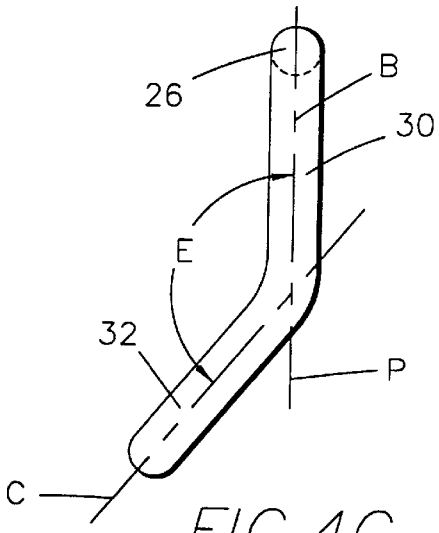
FIG. 4*c* is a view of the anchor shown in FIG. 4*b* looking from the bottom up.

Referring now to FIGS. 4a–c, and in particular to the design of the elongate member 16 of the anchor assembly 2, it should be seen that the member 16 is particularly well adapted to be readily inserted through an opening 44 in a decking 4 such that by moving the elongate member 16 through plural manipulations, the anchor becomes seated about a frame member in the manner shown in FIG. 3. To these ends, the elongate member 16 is constructed, as best seen in FIG. 4*b*, to include the straight shank portion 26 and the first part 30 of the hook member 28 disposed in a common plane P with one another, and the second part 32 of the hook member 28 being disposed out of the illustrated plane P at the illustrated angle E which, in the preferred embodiment, is an angle equal to about 40 degrees.

As illustrated in FIG. 4*a*, the first and second parts of 30 and 32 of the hook member 28 are also disposed relative to one another at the illustrated angle D which is equal to approximately 70 degrees, and the angle between the major and minor axes A and B may vary somewhat between 90 and 100 degrees as illustrated by the indicated angle F in FIG. 4*a*. By so configuring the constituent parts of hook member 28 relative to the overall structure, the anchor member 2 is facilitated in its ability to be readily inserted through a single opening 44 formed in the decking 4, and which opening is only slightly larger in diameter than the outer diameter of the anchor member. The structure of the hook member 28 is generally that which is disclosed in U.S. Pat. No. 4,226,058 issued to Riley on Oct. 7, 1980, which patent being hereby incorporated by reference into the present application.

Figure 5C:
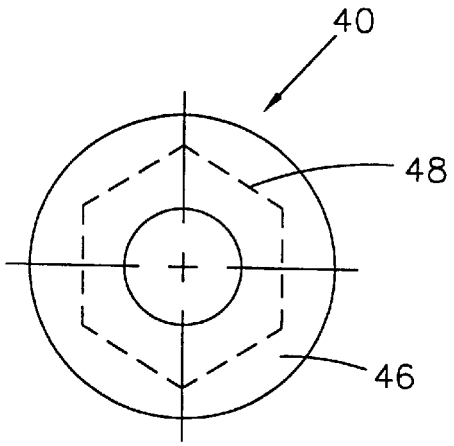
FIG. 5*c* is a view of the locking nut of FIG. 5*a* as seen from the top.
Figure 5A:
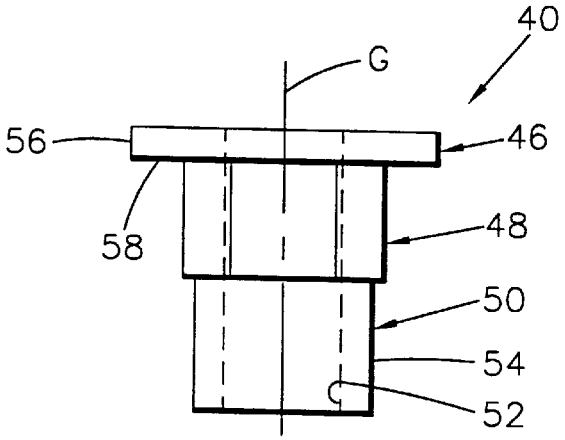
FIG. 5*a* is a side elevation view showing the locking nut of the anchor assembly.
Figure 5B:
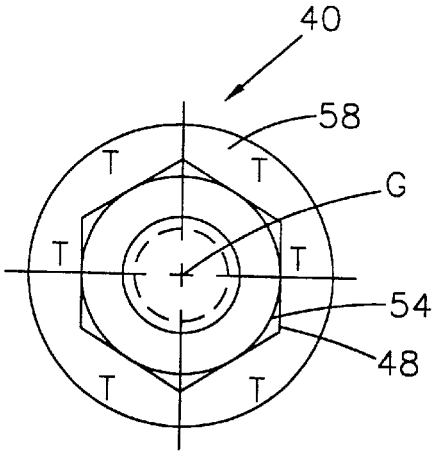
FIG. 5*b* is a view of the locking nut of FIG. 5*a* seen from the bottom up.
Figure 6B:
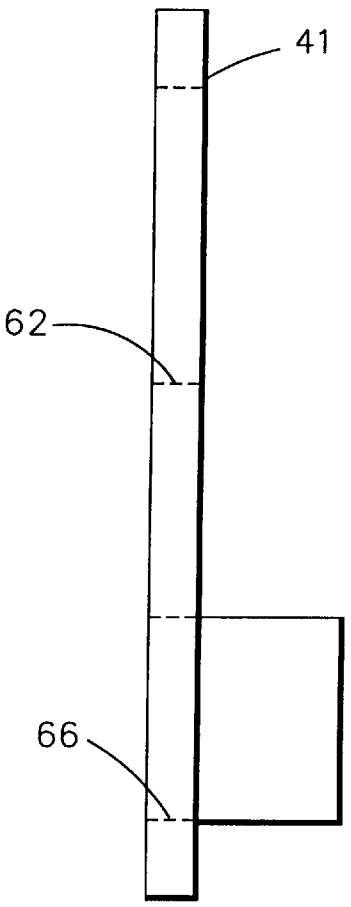
FIG. 6*b* is a side elevation view of the connector shown in FIG. 6*a;*
Figure 6A:
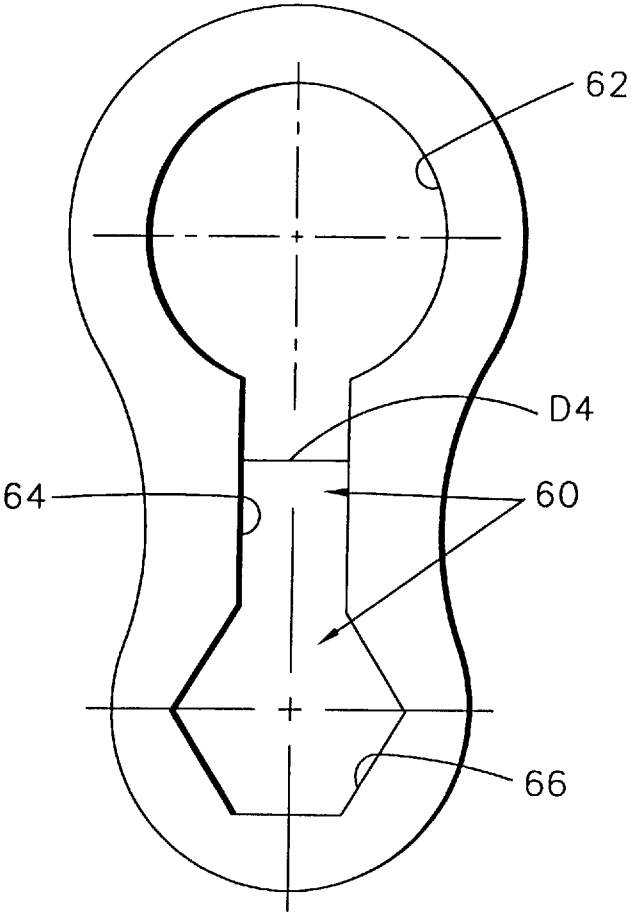
FIG. 6*a* is a plan view of the swivel member used in the device.

Referring now to FIGS. 5*a–c*, 6*a* and *b*, the clamping means 34 for causing the anchor 2 to be secured to the structure 6 includes for this purpose, the locking nut 40 which, as best seen in FIG. 5*a*, is configured with a stepped diameter profile as defined by diameters D-1, D-2 and D-3. Diameter D-1 respectively corresponds to the outer periphery of a nut cap portion 46, the D-2 dimension respectively corresponds to the diameter taken across opposed appex surfaces of a flat sided portion 50, and the D-3 dimension respectively corresponds to the outer diameter of a cylinder surface making up a swivel bearing portion 48. Each of the portions 46, 48 and 50 are concentrically aligned with one another about the nut central axis G disposed coaxially through the nut 40 and having coaxially formed with the central axis G of the nut 40 a threaded opening 52 which is correspondingly threaded to engaged the thread means 36 formed on the straight shank portion 26 of the elongate member 16. Taking the lower cylindrical portion first, it should be seen that the portion 50 is defined by an outer cylindrical surface 54 which acts as a bearing surface as will be discussed in greater detail with reference to FIGS. 6*a* and 6*b*. Above the lower cylindrical portion 50 is disposed the flat sided nut portion 48. As illustrated in FIGS. 5*b* and 5*c* this portion has a generally hexagonal shape with each of the six sided surfaces being disposed symmetrically about the nut axis G. Disposed above the first nut portion 46 is the cap member defined by an outer circular surface 56 which is disposed about the axis G so as to define an annular shoulder surface 58 which, as will become apparent, provides an abutment for retaining the swivel means 48 against removal.

Figure 8:
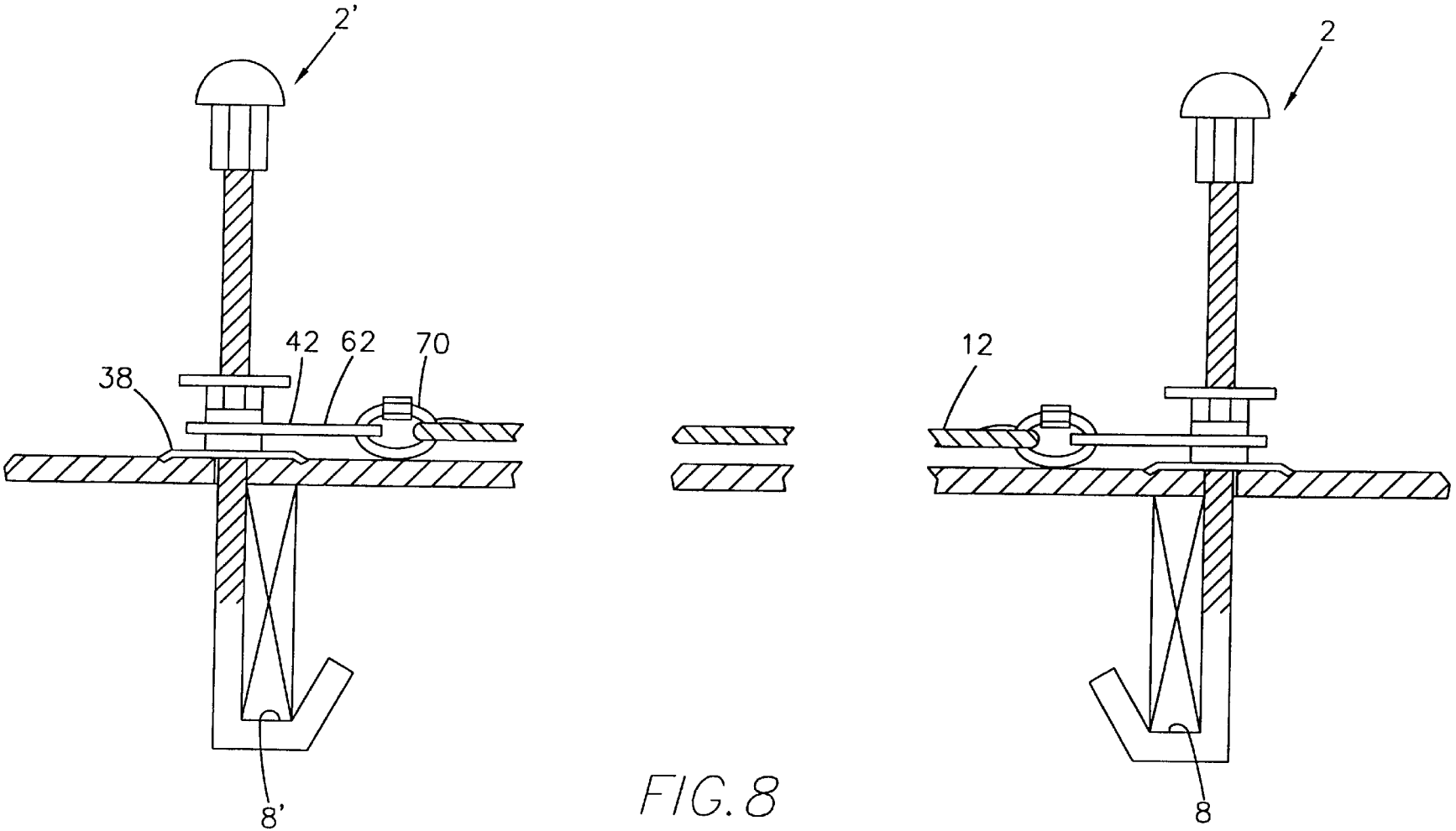
FIG. 8 illustrates in fragmentary side elevation view the alternative embodiment of the duel anchor system shown in FIG. 2.

Referring now to FIGS. 6 and 8, and in particular to the construction of the swivel means 42, it should be seen that the swivel means is defined by a generally flat plate member 41 having a major axis MA about which it is symmetrically disposed and has a removed portion 60 which is defined by a generally circular opening 62 disposed on one side of the plate, and a hexagonally shaped opening 66 disposed on the other opposite side of the plate 41 in line with the axis MA. The illustrated embodiment of the plate 41 includes a slot 64 having a width dimension D-4 which may or may not be smaller in size than the dimension D-2 of the lower cylindric portion 50 of the locking nut. In the illustrated preferred embodiment, however, the slot is sized to prohibit the passing of the nut between the openings 62 and 66 of the plate.

The hexagonally shaped opening 66 is appropriately dimensioned and shaped to fit around the cylindrical surface 54 of the portion 50 of the locking nut 40 as well as being correspondingly sized and shaped to receive the similarly shaped six sided surfaces of the flat portion 58 of the nut 40 so as to be concentrically located about the nut central axis G when the anchor is in its assembled condition as illustrated in FIG. 3. The apexes between the adjacent flat surfaces of the portion 48 of nut 40 restrict passage of the swivel 42 in an upward direction. This is best seen by the illustration in FIG. 5*b* where the cylindrical surface 54 of the nut member 40 can be seen tangent to each of the flat faces of the hexagonal portion 50 of the nut 40 at points T,T. Thus, the hexagonally shaped opening 66 of the swivel plate 41 being sized only slightly larger than the flat surfaces of the portion 50, is capable of being rotatably disposed about the cylindrical surface 54 of the locking nut when the swivel is allowed to rest in its lower disposition as shown in FIGS. 3 and 8. The opening 66 being hexagonally shaped, furthermore allows the swivel 42 to alternatively be used as a wrench to tighten down the locking nut 40 when the swivel plate 41 is moved to its raised position so as to dispose the correspondingly sized flat surfaces of the portion 48 around the portion 50 of the locking hut 40. Further upward movement of the swivel plate 41 is prevented by the abutment shoulder surface 58 of the locking nut 40. When the swivel plate 41 is allowed to drop and be returned to its lowermost condition, the swivel is again freely rotatably mounted about the cylindric nut portion 50. The other opening 62 formed in the swivel plate 41 is sized and shaped so as to be readily connectable to a life line, such as shown in FIG. 1 at element 5, or to a runner line 12 as illustrated in FIG. 2, or to a retractable lifeline device, the connection of which can be effected through the intermediary of a hook or a carabiner 70.

Figure 7A:
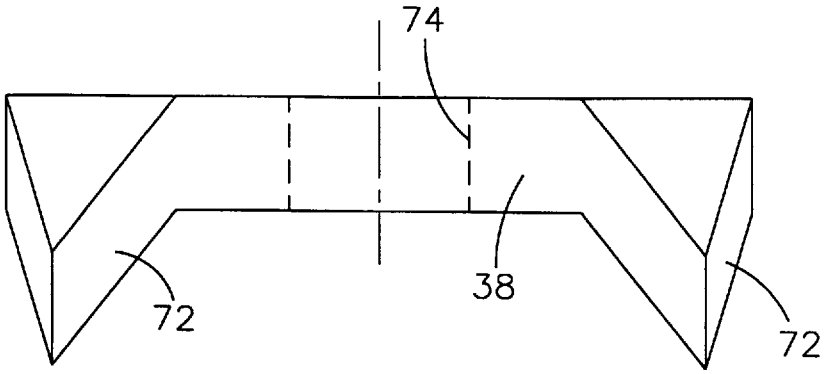
FIG. 7*a* is a side elevation view of a clamping plate usable as part of the clamping means.
Figure 7B:
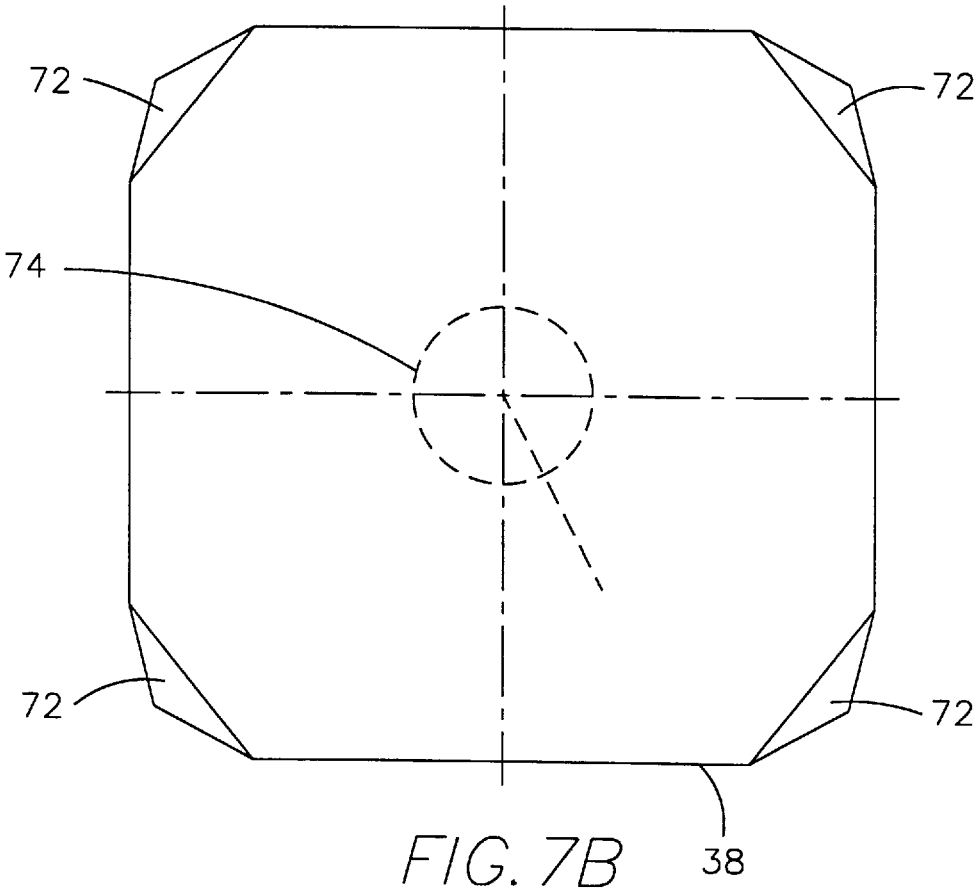
FIG. 7*b* is a plan view of the clamping plate of FIG. 7*a;*
Figure 9A:
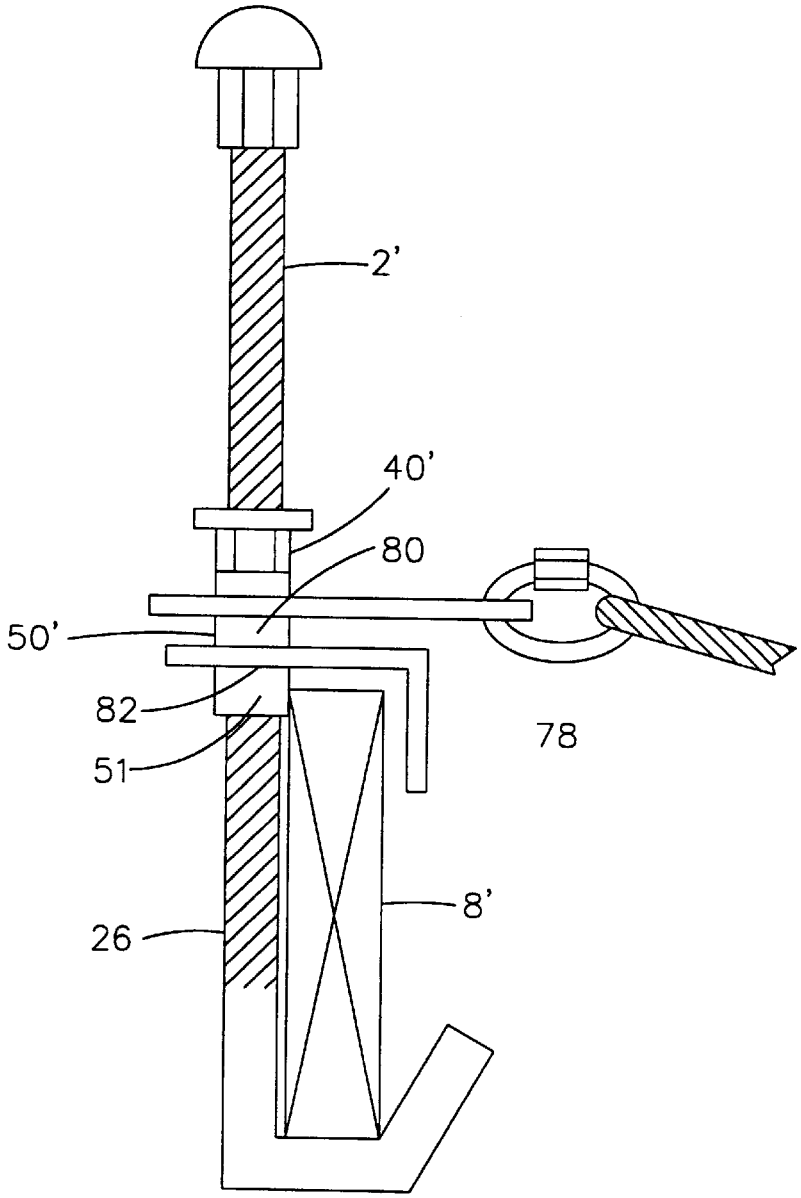
FIG. 9*a* illustrates an alternative embodiment of the roof anchor shown in FIG. 3 secured to frame structure to which no decking is constructed.
Figure 9B:
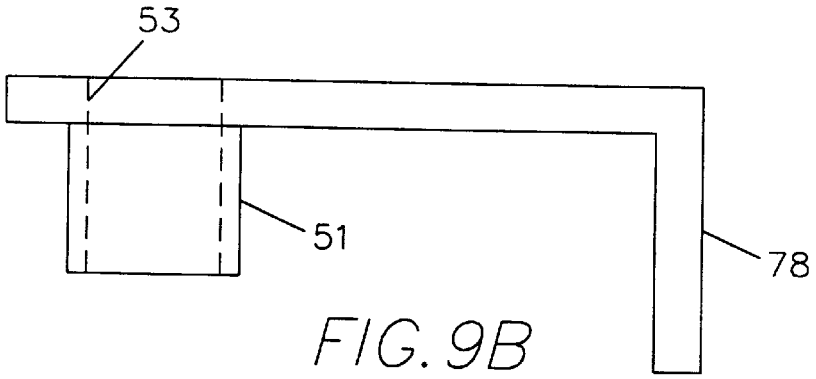
FIG. 9*b* illustrates the mounting bracket of FIG. 9*a* shown apart from the assembly.

Referring now to FIGS. 7*a* and 7*b*, and in particular to the construction of the clamping plate 38 forming part of the clamping means 34, it should be seen that the clamping plate 38 is a generally square planar member having four inturned corners 72,72 directed downwardly thereof and has a through opening 74 disposed symmetrically centrally of the plate. The opening 74 is sufficiently sized to receive the outer diameter of the straight shank portion 26, yet is smaller in diameter than the D-3 diameter of the cylindric nut portion 50 so as to be axially thrusted against the decking 4 as the nut 40 is tightened down. Alternatively, as illustrated in FIG. 9*a*, the anchor 2' may include a top clamping bracket 78 instead of the plate 38 which has a through opening 82 sufficiently sized and shaped to slidingly receive the shank portion 26 of the member 16. As best shown in FIG. 9*b*, the bracket 78 includes a collar 51 integrally formed or welded to the undersurface of the top member of the bracket and communicates with a corresponding aligned opening 53 formed in the bracket to allow the anchor member to slide relative thereto. The bracket 78 supports a spacer 80 which is slidably disposed about the shank portion 26 of the anchor 2' and is thus clamped by the locking nut 40 acting against it and the structural member 8.

In operation a user desiring to secure the anchor to a structural member illustrated as element 8 in FIGS. 1 and 2, will cause a opening 44 to be formed in the decking 4 generally laterally adjacent the involved structural member. Thereafter, the anchor member with the locking nut 40 located at its upper free end, is inserted through the opening by manipulating the hook member end part of the anchor in a manner such as disclosed in U.S. Pat. No. 4,226,058 such that the hook member 28 becomes located along the bottom of the structural member 8 so as to be saddled about its lower surface. Thereafter, while maintaining an upward force on the anchor to ensure the engagement between a hook member and the structural member, the locking nut 40 is thereafter tightened so that the clamping plate 38 is thrust against the top surface of the decking 4. This initial engagement can be done by hand with the final tightening of the locking nut 40 being done using the swivel plate 41. That is, the swivel plate 41 is moved into position around the nut 40 such that the flat side surfaces of the opening 66 are aligned with those corresponding flat side surfaces of the locking nut portion 50, and the swivel plate is thereafter moved upwardly into engagement with the locking nut. Thereafter, tightening of the locking nut against the clamping plate is effected until the desired tensioning of the anchoring member is complete. Thereafter, the swivel plate 41 is moved back around the surface 54 of the cylindric portion 50 where it remains under the force of gravity as shown in FIGS. 4 and 8. An appropriate connection is then made to either a lifeline or a walking line as necessary to the plate 41 at the opening 62. Alternatively, as illustrated in FIGS. 9*a* and 9*b*, an exposed structural member, such as element 8' can be used as the base upon which the anchor 2' is mounted. Here, without decking being present, there is no need to manipulate the hook shaped end of the anchor through an opening. Rather, the hook shaped end of the anchor is simply placed about the under-surface of the structural member 8, and is thereafter pulled upwardly while the clamping bracket 78 is engaged on the top surface of the member. Thereafter the locking nut 40' is turned down onto the clamping plate 78 in the manner as described above until the appropriate tensioning in the anchor has been achieved.

By the foregoing an improved anchor member has been described in the way of the illustrated embodiment. However, numerous modifications and substitutions may be had to the invention with departing from the spirit of the invention. For example, the invention can be practiced alternatively by providing a cylindric bearing section which is disposed about the elongate member and which cooperates with the swivel plate to allow rotatable movement in a number of directions, but which cylindric bearing section is formed as a separate element from the locking nut. Additionally, while illustrated in FIGS. 1 and 2 in the environment of a pitched roof, the anchor 2 is nevertheless contemplated to be used equally effectively in flat roof environments or other environments using framing members.

Accordingly, the invention has been described by way of illustration rather than limitation.

Having thus described the invention, what is claimed is:

1. A single post anchor for securing a safety line to a structure comprising:

(a) an elongate member having a first end and an opposite second end extending along a central axis generally coincident with said first and second ends;

(b) engagement means disposed generally at said second end of said elongate member for engaging a surface of a structure;

(c) clamping means associated with said elongate member and cooperating with said engagement means for clamping the anchor to a structure, said clamping means being disposed on said elongate member for movement axially between said first and said second ends of said elongate member for acting against another surface of a structure so as to clamp the anchor to the structure;

(d) a first bearing surface mounted on said elongate member and extending 360 degrees generally concentrically about said central axis, said first bearing surface being a nonthreaded cylindrical surface;

(e) a member having an opening for receiving said elongate member therein, said member defining a second bearing surface at least part of which rotatably engages with said first bearing surface and rotates freely in 360 degrees thereabout with said clamping means clamping said anchor to the structure; and (f) means for connecting a safety line to said member, (g) whereby said clamping means movement axially along said elongate member from said first end and towards said second end causes clamping of said elongate member against another surface of a structure without restricting said member from rotation about said elongate member in 360 degrees.

2. An anchor as defined in claim 1 further characterized in that said engagement means includes a hook member formed with said elongate member and extending generally laterally from said elongate member at said second end of said anchor.

3. An anchor as defined in claim 2 further characterized by said member being a flat swivel plate.

4. An anchor as defined in claim 3 further characterized in that said safety line is a retractable lifeline.

5. An anchor as defined in claim 3 further characterized in that said safety line is a walking line.

6. An anchor as defined in claim 3 further characterized in that said first bearing surface is part of said clamping means and the clamping means prevents the swivel plate from being axially pulled away in a direction toward said anchor first end.

7. An anchor as defined in claim 6 further characterized in that said clamping means includes a locking nut having a generally stepped configuration as defined by at least two different diameters one of which diameters defining said first bearing surface.

8. An anchor as defined in claim 7 further characterized by said stepped configuration of said lock nut including a first portion defined by a first diameter, a second portion having at least two opposed flat surfaces and defining a second diameter portion less than said first diameter and a third portion having a cylindric surface defining said first bearing surface and a diameter which is less than said second nut portion diameter as measured across said at least two flat opposed surfaces.

9. An anchor as defined in claim 8 further characterized in that said swivel plate member having removed portions, one of which removed portions having at least two opposed flat surfaces spaced slightly larger in dimension than the spacing between said at least two flat surfaces on said second nut portion.

10. An anchor as defined in claim 9 further characterized by a clamping element being disposed between said locking nut and said second end of said elongate member for engagement with said another surface of said structure.

11. An anchor as defined in claim 10 further characterized in that said clamping element is of a square shaped plate and includes an opening formed centrally of said plate and having four inturned corners adapted to engage and pierce a decking comprising part of a structure.

12. An anchor as defined in claim 10 further characterized in that said clamping element is a bracket having an L-shape and being adaptable for engaging over another surface of a structure not covered by decking.

13. An anchor as defined in claim 1 further characterized in that said anchor is included as part of a system wherein a first and a second anchor are disposed substantially in line with one another and each of said anchors is connected with one another through a tension line which extends between the first and second anchors through the intermediary of a hook which is received within a removed portion of the swivel plate.

14. A method of securing a safety line to a structural member which is disposed beneath a roof surface comprising:

(a) providing an anchor member having a generally elongate portion and a portion which is configured to engage around a structural member, providing a first bearing surface mounted on said elongate portion and extending 360 degrees generally concentrically about the central axis of said elongate portion, providing said first bearing surface and mounting same on said anchor member and Providing said first bearing surface as a nonthreaded cylindrical surface, providing a clamping means associated with said anchor member for clamping the anchor to a structure, said clamping means being disposed on said elongate portion of said anchor member for movement axially between first and second ends thereof, providing a member having an opening for receiving said elongate portion of said anchor member therein, said member defining said second bearing surface adapted to engage with said first bearing surface and to rotate freely in 360 degrees thereabout with said clamping means clamping said anchor to the structure and;

(b) causing an opening to be formed in said roof and causing said portion of said anchor member which is configured to engage around a structural member to be inserted into said roof opening and to be positioned relative to the structural member so as to act on at least one surface of the structural member;

(c) providing said clamping means on said anchor member such that it causes said portion of said-anchor member which is configured to engage around a structural member to become clamped to said structural member by causing at least another surface cooperating with said structural member to be acted on and in turn act on the roof surface and hence hold the anchor member in place while simultaneously permitting rotation of said member about said anchor member and causing said clamping means to move axially along said elongate portion of said anchor member to clamp said anchor member against another surface of a structure without restricting said member from rotation about said elongate portion of said anchor member in 360 degrees;

(d) providing a means associated with the generally elongate portion of said anchor member for attaching a safety line to said anchor member; and (e) connecting a safety line to said means for attaching a safety means to an anchor.

15. A method as defined in claim 14 further characterized by said means for attaching a safety line to the anchor member includes a swivel member.

16. A method as defined in claim 15 further characterized by providing said safety line as a lifeline and connecting one end of the lifeline to the swivel member.

17. A method as defined in claim 15 further characterized by providing said safety line as a retractable lifeline device and connecting the retractable lifeline device to the swivel member.

* * * * *